US007738807B2

(12) United States Patent
Inada et al.

(10) Patent No.: US 7,738,807 B2
(45) Date of Patent: Jun. 15, 2010

(54) CONTROL FOR CLEANING IMAGE CARRIER SURFACE IN IMAGE FORMING DEVICE

(75) Inventors: Yasuyuki Inada, Toyokawa (JP); Takashi Akazawa, Toyokawa (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 700 days.

(21) Appl. No.: 11/592,300

(22) Filed: Nov. 3, 2006

(65) Prior Publication Data

US 2007/0286636 A1 Dec. 13, 2007

(30) Foreign Application Priority Data

Jun. 12, 2006 (JP) ..... 2006-162715

(51) Int. Cl.
*G03G 15/00* (2006.01)

(52) U.S. Cl. ..... 399/71

(58) Field of Classification Search ..... 399/43, 399/44, 71, 101, 297, 343, 350
See application file for complete search history.

(56) References Cited

U.S. PATENT DOCUMENTS 6,813,467 B2 * 11/2004 Kawahara et al. ..... 399/353
2005/0191069 A1 * 9/2005 Yamaki et al. ..... 399/44

FOREIGN PATENT DOCUMENTS

| | | | |
|---|---|---|---|
| EP | 0445718 | | 9/1991 |
| JP | S63-36286 | | 2/1988 |
| JP | 3-158883 | | 7/1991 |
| JP | 5-333748 | | 12/1993 |
| JP | 05333748 A | * | 12/1993 |
| JP | 7-175394 | | 7/1995 |
| JP | 09204127 A | * | 8/1997 |
| JP | 10010939 A | * | 1/1998 |
| JP | 10-333455 | | 12/1998 |
| JP | 11-24521 | | 1/1999 |
| JP | 11024521 A | * | 1/1999 |
| JP | 11038855 A | * | 2/1999 |
| JP | 2000155514 A | * | 6/2000 |
| JP | 2000-305440 | | 11/2000 |
| JP | 2000305440 A | * | 11/2000 |
| JP | 2002311771 A | * | 10/2002 |

(Continued)

OTHER PUBLICATIONS

Japanese Office Action mailed on Dec. 24, 2008 directed at counterpart application No. 2006-162715; 8 pages.

(Continued)

*Primary Examiner*—Robert Beatty
(74) *Attorney, Agent, or Firm*—Morrison & Foerster LLP

(57) ABSTRACT

An image forming device including a cleaning member that is made of an elastic material and cleans the surface of the image carrier by contacting with the surface. The drive unit rotates the image carrier in a reverse direction while the cleaning member is contacting with the surface of the image carrier, before the image carrier is rotated in a positive direction for an image formation. The control unit controls the rotation of the image carrier in the reverse direction, in accordance with information indicating a size of a frictional force generated between the cleaning member and the image carrier being rotated.

6 Claims, 16 Drawing Sheets

1

FOREIGN PATENT DOCUMENTS

| | | | | |
|---|---|---|---|---|
| JP | 2003-122195 | | | 4/2003 |
| JP | 2004-145206 | | | 5/2004 |
| JP | 2004-264553 | | | 9/2004 |
| JP | 2004264508 | A | * | 9/2004 |
| JP | 2005017776 | A | * | 1/2005 |
| JP | 2005031431 | A | * | 2/2005 |
| JP | 2005-257787 | | | 9/2005 |
| JP | 2005-300916 | | | 10/2005 |
| JP | 2005-321577 | | | 11/2005 |

OTHER PUBLICATIONS

Notification for Reasons for Refusal mailed Apr. 30, 2008 directed towards Japanese patent application 2006-162715.

Japanese Notification of Reasons for Refusal mailed Jul. 28, 2009, directed to counterpart Japanese Patent Application No. 2008-170504; 12 pages.

Chinese Office Action mailed on Mar. 17, 2010 direceted at application No. 200610168455.x; 10 pages.

* cited by examiner

FIG.3

201

| PRECEDING COVERAGE RATE | 30% OR MORE | ~15% | ~5% | LESS THAN 1% |
|---|---|---|---|---|
| NUMBER OF REVERSE ROTATIONS | 5 | 3 | 1 | 0 |

FIG.6

202

| INTERNAL TEMPERATURE OF DEVICE | 10°C OR LESS | ~12°C | ~14°C | ~16°C | ~30°C | 30°C OR MORE |
|---|---|---|---|---|---|---|
| NUMBER OF REVERSE ROTATIONS | 5 | 4 | 3 | 2 | 1 | 0 |

FIG.13

203

| TOTAL NUMBER OF PRINTS | 500 OR LESS | 501~1000 | 1001~5000 | 5001~10000 | 10001 OR MORE |
|---|---|---|---|---|---|
| DISTANCE OF REVERSE ROTATION | 0mm | 2mm | 3mm | 5mm | 10mm |

FIG. 14

204

| TOTAL ROTATION TIME | 30 MIN OR LESS | TO 1 HOUR | TO 10 HOURS | MORE THAN 10 HOURS |
|---|---|---|---|---|
| REVERSE ROTATION TIME | 0 SEC | 0.4 SEC | 0.5 SEC | 0.8 SEC |

FIG.15

205

| PRECEDING PRINT MODE | SINGLE-SIDE CONTINUOUS, 3 SHEETS OR LESS | SINGLE-SIDE CONTINUOUS, 4-50 SHEETS | SINGLE-SIDE CONTINUOUS, 51-200 SHEETS | SINGLE-SIDE CONTINUOUS, MORE THAN 200 SHEETS | BOTH SIDE CONTINUOUS, LESS THAN 100 SHEETS |
|---|---|---|---|---|---|
| REVERSE ROTATION ACCELERATION ($mm/s^2$) | 0.5 | 0.75 | 1.25 | 5 | 2.5 |

CONTROL FOR CLEANING IMAGE CARRIER SURFACE IN IMAGE FORMING DEVICE

This application is based on application No. 2006-162715 filed in Japan, the contents of which are hereby incorporated by reference.

BACKGROUND OF THE INVENTION (1) Field of the Invention

The present invention relates to an image forming device that includes a cleaning unit for cleaning the surface of an image carrier by contacting with the surface, and to an image forming method for the image forming device.

(2) Description of the Related Art

In recent years, tandem printers have become prevalent. In these tandem printers, a plurality of image creating units, a photosensitive drum, and a transferring unit are arranged along an intermediate transfer belt, toner images formed by the image creating units are transferred onto the intermediate transfer belt by a multiple transfer, and the toner images of respective colors are transferred from the intermediate transfer belt onto a recording sheet all at once to obtain a full-color image.

In such printers, a cleaner is used to remove remnant toners remaining on the surface of the intermediate transfer belt after the transferring, or to remove paper powder or the like attached to the surface of the transfer belt. A typical method of cleaning the remnant toners or the like is to press a cleaning blade, which is made of an elastic material such as polyurethane, onto the intermediate transfer belt surface to collect the remnant toners or the like by shaving them off.

In this method of contacting the cleaning blade, however, as shown in FIG. 16A, as the number of prints increases, more amounts of remnant toner, paper powder, dust and the like become present between a contacting surface 903 of a cleaning blade 901 and an intermediate transfer belt 902. Then it becomes as if a foreign object is inserted between the cleaning blade 901 and the intermediate transfer belt 902, in which minute gaps are created between them and toners and the like pass through the gaps to cause a defective cleaning.

Japanese Patent Application Publication No. 2005-300916 discloses a construction in which the intermediate transfer belt is rotated in the reverse direction by a predetermined amount before the belt is driven to be rotated in the positive direction (positive rotation). With this reverse rotation, the paper powder and the like are liberated from between the cleaning blade 901 and the intermediate transfer belt 902, and fly away from the cleaning blade 901, as shown in FIG. 16B. This allows the cleaning blade 901 and the intermediate transfer belt 902 to return to the normal contact state in which the foreign object has been removed from between the cleaning blade 901 and the intermediate transfer belt 902, as shown in FIG. 16C.

FIG. 16C shows the state in which the cleaning blade 901 is in close contact with the intermediate transfer belt 902. In the actuality, however, when the cleaning blade 901 and the intermediate transfer belt 902 returns to the normal contact state as the positive rotation is started, remnants such as the toner and a toner additive like silica remaining between the cleaning blade 901 and the intermediate transfer belt 902 play a role of a lubricant agent that keeps the frictional force, which occurs between the cleaning blade 901 and the intermediate transfer belt 902, to an appropriate size. And this prevents an inverse warpage of the cleaning blade 901 which occurs due to the friction.

The paper powder and the like having flown away come back before the cleaning blade 901 as the intermediate transfer belt 902 rotates in the positive direction, and are shaved off and collected by the cleaning blade 901 since the contact state of the cleaning blade 901 has returned to the normal state by then.

However, with the construction disclosed in the above-mentioned Japanese Patent Application Publication, an inverse warpage may occur, for the following reasons.

For example, when an image read out from a document having a low coverage rate is printed continuously onto a large number of sheets, only a small amount of toner is transferred to the surface of the intermediate transfer belt 902, and thus a small amount of toner and toner additive becomes present between the cleaning blade 901 and the intermediate transfer belt 902.

If, in this state after the print job, the intermediate transfer belt 902 is driven to be rotated in the reverse and positive directions before it is rotated in the positive direction for another job, the toner and toner additive, which are present between the cleaning blade 901 and the intermediate transfer belt 902 and play a role of a lubricant agent although a small amount, are removed from the cleaning blade 901 by the reverse rotation, and hardly exist when the intermediate transfer belt 902 is rotated in the positive direction.

This increase the frictional force between the cleaning blade 901 and the intermediate transfer belt 902. And when this happens, the edge of the cleaning blade 901 is pulled by the intermediate transfer belt 902 that moves in the positive direction, and is warped in the inverse direction by the force of the moving intermediate transfer belt 902, as shown in FIG. 16D.

When such an inverse warpage occurs, the cleaning blade 901 may be deformed or cut in part, becomes unable to shave the toner off fully, and the cleaning performance is degraded.

This problem is not limited to the cleaning blade for cleaning the intermediate transfer belt, but may also occur, for example, to the cleaning blade for cleaning remnant toner from the photosensitive drum.

SUMMARY OF THE INVENTION

The object of the present invention is therefore to provide an image forming device which, with a construction of including a cleaning member for cleaning remnant from the surface of an image carrier such as an intermediate transfer belt, and causing the image carrier to rotate in the reverse direction before the image carrier is rotated in the positive direction, prevents an inverse warpage of the cleaning member, and to provide an image forming method.

The above object is fulfilled by an image forming device comprising: an image carrier; a cleaning member, made of an elastic material, operable to clean a surface of the image carrier by contacting with the surface; a drive unit operable to rotate the image carrier in a reverse direction while the cleaning member is contacting with the surface of the image carrier, before the image carrier is rotated in a positive direction for an image formation; and a control unit operable to control the rotation of the image carrier in the reverse direction, in accordance with information indicating a size of a frictional force generated between the cleaning member and the image carrier being rotated.

It should be noted here that the control defined as to "control the rotation of the image carrier in the reverse direction" includes the case of prohibiting the image carrier from rotating, as well as the case of rotating it.

With the above-stated construction in which the control unit controls the rotation of the image carrier in the reverse direction, in accordance with the information indicating the size of the frictional force, it is possible to prevent the inverse warpage of the cleaning member, while improving the cleaning.

The above object is also fulfilled by an image forming device comprising: an image carrier; a cleaning member, made of an elastic material, operable to clean a surface of the image carrier by contacting with the surface; a drive unit operable to rotate the image carrier in either a reverse direction or a positive direction; a detection unit operable to detect a state of the image forming device; a control unit operable to, upon receiving an image formation start signal, select a first operation mode or a second operation mode in accordance with the detected device state, wherein in the first operation mode, the image carrier is rotated in the reverse direction and then rotated in the positive direction, and in the second operation mode, the image carrier is rotated in the positive direction without being rotated in the reverse direction.

With the above-stated construction in which the control unit selects the first operation mode or the second operation mode in accordance with the state of the image forming device, it is possible to prevent the inverse warpage of the cleaning member, while improving the cleaning.

BRIEF DESCRIPTION OF THE DRAWINGS

These and the other objects, advantages and features of the invention will become apparent from the following description thereof taken in conjunction with the accompanying drawings which illustrate a specific embodiment of the invention. In the drawings:

FIG. 3 shows the contents of the reverse rotation information table 201 provided in the control unit 100;

FIG. 6 shows the contents of a reverse rotation information table 202 in the Second Embodiment;

FIG. 13 shows the construction of a reverse rotation information table 203 in a modification;

FIG. 14 shows the construction of a reverse rotation information table 204 in a modification;

FIG. 15 shows the construction of a reverse rotation information table 205 in a modification.

DESCRIPTION OF THE PREFERRED EMBODIMENT

The following describes embodiments of the image forming device and image forming method of the present invention, taking a tandem color digital printer (hereinafter, merely referred to as a printer) as an example.

First Embodiment

Figure 1:
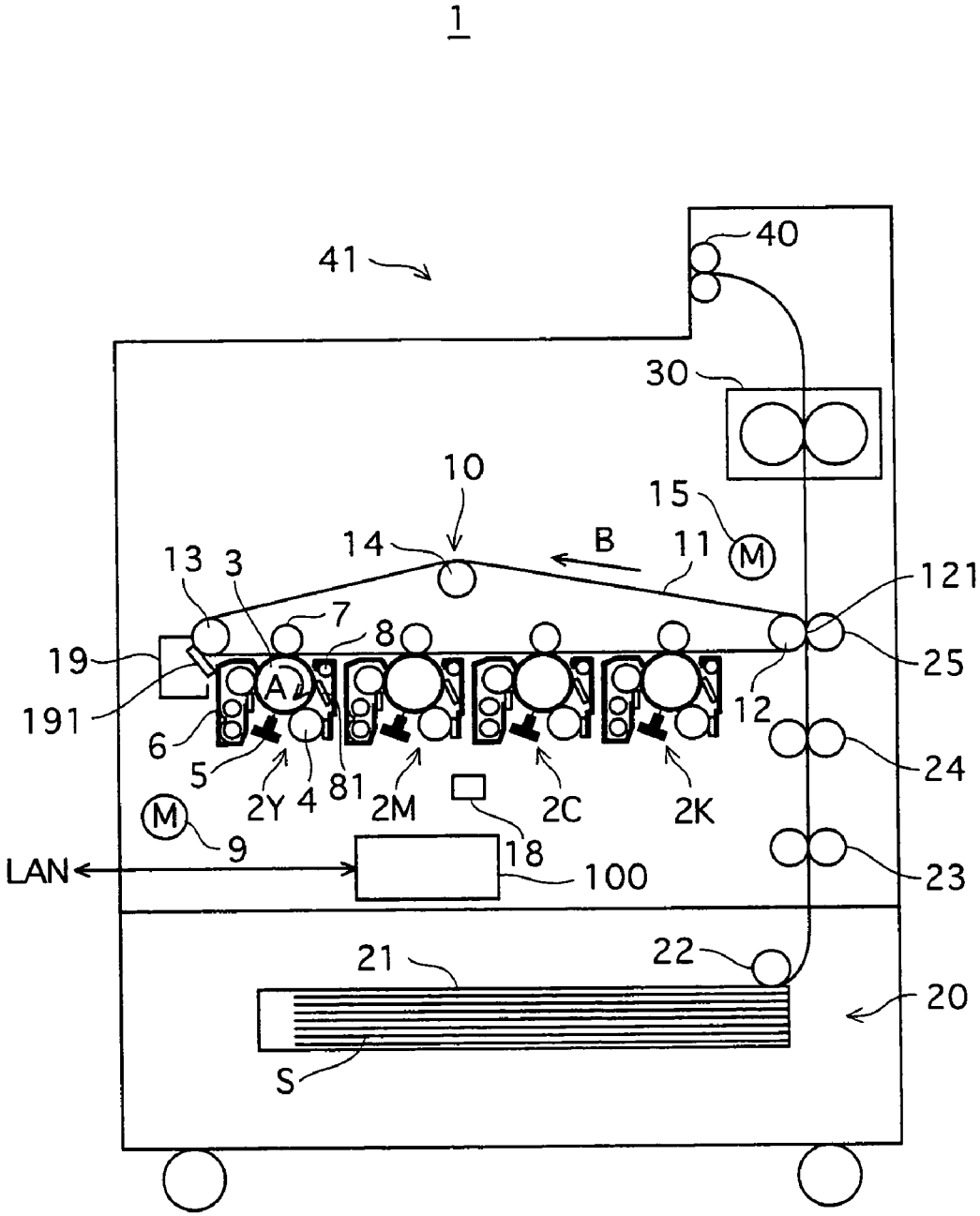
FIG. 1 shows an overall construction of a printer 1 in the First Embodiment.

FIG. 1 shows an overall construction of a printer 1 in the first embodiment. As shown in FIG. 1, the printer 1 includes an image processing unit 10, a feeding unit 20, a fixing unit 30, and a control unit 100. Upon receiving an instruction to execute a print job from an external terminal device (not illustrated) via a network (in this example, a LAN) to which the printer 1 is connected, the printer 1 executes the print job according to the received instruction.

The image processing unit 10 includes image creating units 2Y, 2M, 2C, and 2K corresponding respectively to colors of yellow (Y), magenta (M), cyan (C), and black (K), a drum drive motor 9, an intermediate transfer belt 11 in the shape of a loop, a belt drive motor 15, and a belt cleaning unit 19.

The image creating units 2Y includes a photosensitive drum 3 that is driven by the drum drive motor 9 to rotate in the direction indicated by the arrow A shown in FIG. 1, a charge roller 4, an exposing unit 5, a developing unit 6, an initial transfer roller 7, and a drum cleaning unit 8.

The drum cleaning unit 8 includes a cleaning blade 81 made of an elastic material such as a urethane rubber. The cleaning blade 81 is held in the state in which its edge contacts the surface of the photosensitive drum 3 in the counter direction to the rotation direction A of the photosensitive drum 3, to shave off the remnant toners, paper powder and the like from the drum surface for the cleaning thereof. The remnant toners and the like shaved off by the cleaning blade 81 are collected in a collection container (not illustrated). The construction of the image creating unit 2Y similarly applies to the other image creating units 2M-2K. It should be noted here that the direction of the cleaning blade 81 to the photosensitive drum 3 is not limited to the counter direction. For example, the cleaning blade 81 may be disposed such that its edge faces to the same direction as the rotation of the photosensitive drum 3.

The intermediate transfer belt 11 is suspended with tension between a drive roller 12, a passive roller 13, and a tension roller 14, and is driven by the belt drive motor 15 to rotate in the direction indicated by the arrow B shown in FIG. 1. The intermediate transfer belt 11 is made of, for example, a material that is made by dispersing a carbon in a polyphenylene sulfide (PPS) resin so as to have a surface resistivity in the range of $1\times10^{7}$ to $1\times10^{12}$ [Ω/□]. The intermediate transfer belt 11 may be made of a resin such as a polycarbonate (PC) resin, a polyimide (PI) resin, an urethane resin, a fluorine resin, or a nylon resin, an elastic material such as a silicon rubber or a urethane rubber, or a material made by dispersing conductive powder or a carbon in any of these materials so as to have a desired resistance.

The belt cleaning unit 19 includes a cleaning blade 191. The cleaning blade 191 is held in the state in which its edge contacts the surface of the intermediate transfer belt 11 in the counter direction to the rotation direction B of the intermediate transfer belt 11, to shave off the remnant toners, paper powder and the like from the belt surface for the cleaning thereof. The remnant toners and the like shaved off by the cleaning blade 191 are collected in a collection container (not illustrated).

The feeding unit 20 includes a paper feed cassette 21 for storing sheets S, a pickup roller 22 for picking up the sheets S from the paper feed cassette 21 one by one, a pair of transport rollers 23 for transporting the picked-up sheet S, a pair of timing rollers 24 for taking a timing for transporting the sheet S onto a secondary transfer position 121, and a secondary transfer roller 25.

The control unit 100 receives an image signal from an external terminal apparatus, converts the received image signal into digital image signals respectively for the colors Y-K, and controls the image processing unit 10, the feeding unit 20 and the like to perform a print operation.

More specifically, in each of the image creating units 2Y, 2M, 2C, and 2K, the charge roller 4 causes the surface of the photosensitive drum 3, which rotates in the arrow A direction, to be uniformly charged, the exposing unit 5 exposes the charged surface of the photosensitive drum 3 to form a static latent image, and the developing unit 6 develops the formed static latent image to form a toner image. A developing toner may be, for example, a polymerized toner having the particle size of 7 [μm] or less. It is preferable that a polymerized toner having the particle size in the range from 4.5 [μm] to 6.5 [μm] inclusive is used as the developing agent. Not limited to this, but other production methods may be adopted.

The developed toner images of each color are transferred from the photosensitive drum 3 to the surface of the intermediate transfer belt 11 by the electrostatic action of each initial transfer roller 7, which is referred to as an initial transfer. In this initial transfer, the toner images of each color are transferred at shifted timings so that they are layered on the intermediate transfer belt 11 at the same position.

As the intermediate transfer belt 11 rotates, the toner images of each color on the intermediate transfer belt 11 is moved to a secondary transfer position 121.

On the other hand, at a timing corresponding to the timing for moving the toner images of each color on the intermediate transfer belt 11, the feeding unit 20 feeds the sheet S via the pair of timing rollers 24, and the sheet S is transported while it is sandwiched by the rotating intermediate transfer belt 11 and secondary transfer roller 25. Then at the secondary transfer position 121, the toner images of each color are transferred from the intermediate transfer belt 11 to the sheet S by the electrostatic action, which is referred to as a second transfer.

The sheet S having passed the secondary transfer position 121 is transported to the fixing unit 30. The fixing unit 30 fixes the toner image onto the sheet S by heating and pressing. The sheet S with the fixed image is then ejected onto a tray 41 via a pair of eject rollers 40.

The drum cleaning unit 8 removes remnant toners of the initial transfer remaining on the surface of the photosensitive drum 3, and removes paper powder or the like attached to the surface of the photosensitive drum 3. Similarly, the belt cleaning unit 19 removes remnant toners, paper powder and the like remaining on the surface of the intermediate transfer belt 11 after the secondary transfer. Hereinafter, when both the cleaning blade 81 and cleaning blade 191 are mentioned, only the name "cleaning blade" will be written, omitting the reference numbers.

A temperature detect sensor 18 is disposed in the vicinity of the image creating units 2Y, 2M, 2C, and 2K within the device. The temperature detect sensor 18 detects an internal temperature of the device and sends a detection signal of the detected temperature to the control unit 100.

Figure 2:
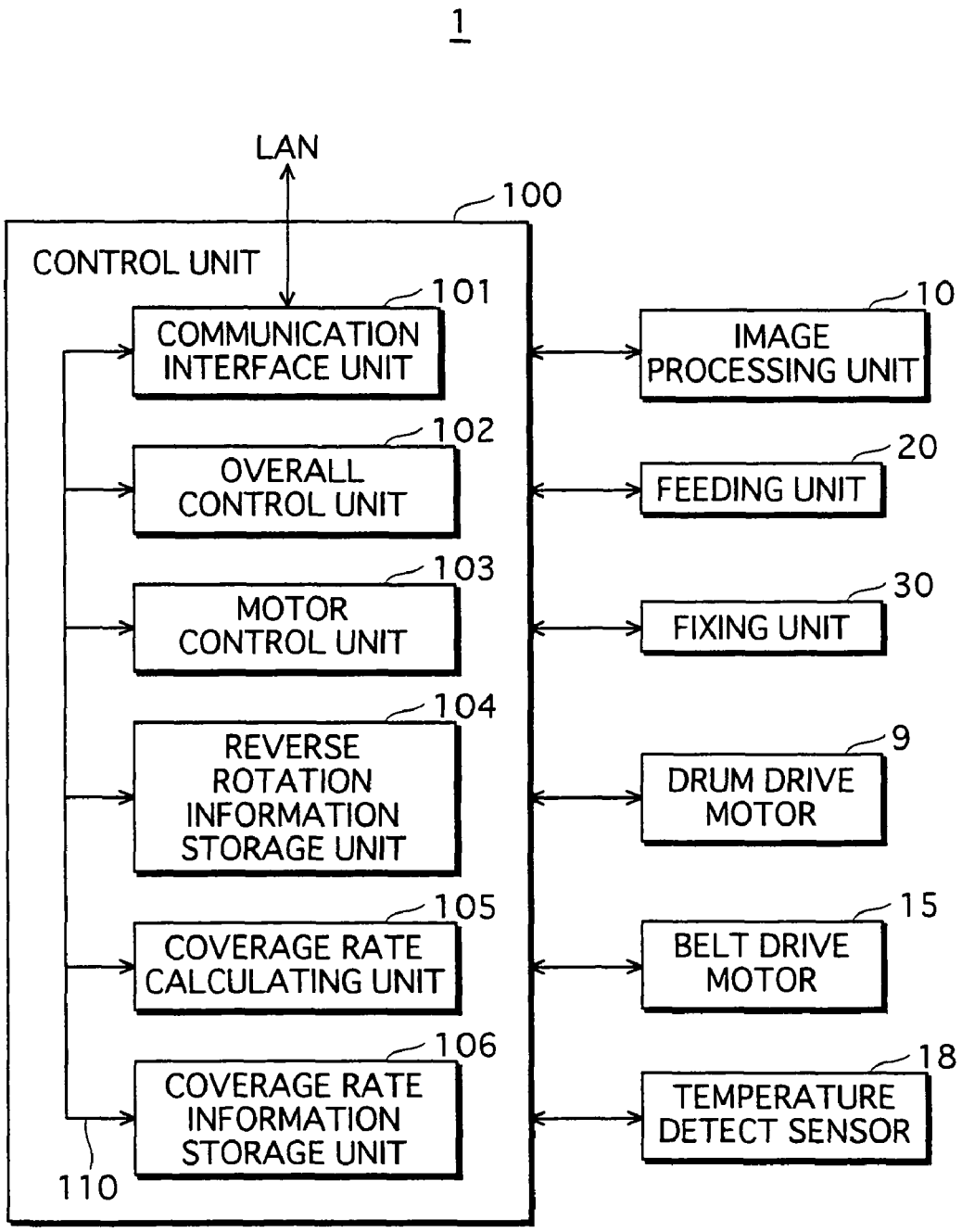
FIG. 2 shows the construction of the control unit 100 of the printer 1.

FIG. 2 shows the construction of the control unit 100.

As shown in FIG. 2, the control unit 100 includes, as the main constituents, a communication interface unit 101, an overall control unit 102, a motor control unit 103, a reverse rotation information storage unit 104, a coverage rate calculating unit 105, and a coverage rate information storage unit 106. A data transmission/reception between these units is available via a bus 110.

The communication interface unit 101 is an interface achieved in a LAN card, a LAN board or the like and is used to connect with a LAN.

The overall control unit 102 controls the overall operation of the image processing unit 10, the feeding unit 20 and the like to realize a smooth printing operation. The overall control unit 102 also receives a detection signal from the temperature detect sensor 18, monitors the internal temperature of the device, and performs a stability control so as to stabilize the quality of the output image appropriately even if a temperature change causes the sensitivity property of the photosensitive drum 3 and the developing property of the toners to change. The stability control is achieved by a known γ correction for correcting the amount of electric charges at a print, the amount of exposure and the like to appropriate values corresponding to the internal temperature of the device.

The coverage rate calculating unit 105 calculates a coverage rate P. Here, the coverage rate P is represented by expression $P=(Sb/Sa)\times 100[\%]$, where Sa represents the total number of pixels per sheet, and Sb represents the number of printed pixels on a sheet. The coverage rate may be obtained using the above expression on the premise that Sa represents the area of one sheet, and Sb represents the area of the printed image on a sheet.

The coverage rate calculating unit 105 calculates the coverage rate P by obtaining the values Sa and Sb from a received image signal each time printing onto a sheet is executed.

The coverage rate information storage unit 106 is achieved by a nonvolatile storage unit, and stores therein the calculated coverage rate P as the coverage rate information. The coverage rate information may be updated per sheet (only the latest piece of coverage rate information is stored), or may be accumulated to show the history. Since the coverage rate for only one sheet may be used, for example, the coverage rate may be obtained from the external terminal device together with the image signal. In this case, the calculation by the coverage rate calculating unit 105 is not necessary.

The motor control unit 103 performs a motor drive control process for controlling the rotational operation by supplying electric current to the drum drive motor 9 and the belt drive motor 15. More specifically, as shown in FIG. 1, the motor control unit 103 drives the photosensitive drum 3 to rotate in the arrow A direction, and drives the intermediate transfer belt 11 to rotate in the arrow B direction. Hereinafter, the direction of these rotations is referred to as a positive direction, and the rotation in the positive direction is referred to as a positive rotation. The motor control unit 103 also performs a control to rotate the drum or belt in the reverse direction before it rotates the drum or belt in the positive direction. Hereinafter, the rotation in the reverse direction is referred to as a reverse rotation.

The reverse rotation is controlled in accordance with the coverage rate in the preceding print job, as will be described later. More specifically, the number of reverse rotations "n" is changed in accordance with the coverage rate in the preceding print job, where a positive/reverse rotation is repeated as follows: a predetermined amount of reverse rotation from a stopped state to a stopped state ($1^{st}$ reverse rotation), a predetermined amount of positive rotation to a stopped state ($1^{st}$ positive rotation), a predetermined amount of reverse rotation to a stopped state ($2^{nd}$ reverse rotation), . . . a predetermined amount of positive rotation to a stopped state ($(n-1)^{th}$ positive rotation), and a predetermined amount of reverse rotation to a stopped state ($n^{th}$ reverse rotation).

The reverse rotation information storage unit 104 is achieved by a nonvolatile storage unit, and stores therein a reverse rotation information table 201 in which reverse rotation information, which indicates the number of reverse rotations of the photosensitive drum 3 and the intermediate transfer belt 11, is written.

FIG. 3 shows the contents of the reverse rotation information table 201.

As shown in FIG. 3, the reverse rotation information table 201 shows correspondence between the coverage rate in the preceding print and the number of reverse rotations. As will be understood from FIG. 3, the number of reverse rotations decreases as the coverage rate decreases, and the number of reverse rotations increases as the coverage rate increases. The number of reverse rotations is "0" (the reverse rotation is prohibited) when the coverage rate in the preceding print job is less than 1%.

These arrangements are provided in order to prevent an inverse warpage.

That the coverage rate in the preceding print job is high means that a large amount of toners and toner additives is present between the cleaning blade 81 and the photosensitive drum 3 and the frictional force between them is small, compared with the case where the coverage rate in the preceding print job is low. This indicates that the possibility of occurrence of the inverse warpage is low even after the number of reverse rotations is increased to some extent.

On the contrary, when the coverage rate in the preceding print job is low, as explained earlier in the Description of the Related Art, a small amount of toners and toner additives is present between the cleaning blade 81 and the photosensitive drum 3 and the frictional force between them is large. When the reverse rotation is performed under these conditions, although they are small in amount, the toners and toner additives fly away from the cleaning blade 81; and when the positive rotation is performed, there is a high possibility that the inverse warpage occurs due to the frictional force that has been increased by the smallness of the toners and toner additives that are present between the cleaning blade 81 and the photosensitive drum 3.

Especially, when the coverage rate in the preceding print job is less than 1%, the possibility of occurrence of the inverse warpage is extremely high, and thus the reverse rotation is prohibited. In this sense, the coverage rate is regarded as information that indicates the size of the frictional force generated between the cleaning blade 81 and the rotating photosensitive drum 3. This similarly applies to the cleaning blade 191 and the intermediate transfer belt 11.

The values of the coverage rate and the number of reverse rotations are not limited to the above-stated ones, but may be determined preliminarily from experiments and the like, to be optimum values in the range in which the foreign objects such as paper powder that remain under the cleaning blade edge can be removed effectively and the inverse warpage of the blade does not occur, taking into accounts the materials of the cleaning blade and toners, the rotation speed of the photosensitive drum 3 and the intermediate transfer belt 11, the pressing force applied to the cleaning blade and the like.

Next, the motor drive control process will be explained with reference to FIGS. 4 and 5. The process is performed when a printing operation is started upon reception of a request to execute a print job (image forming start signal).

Figure 4:
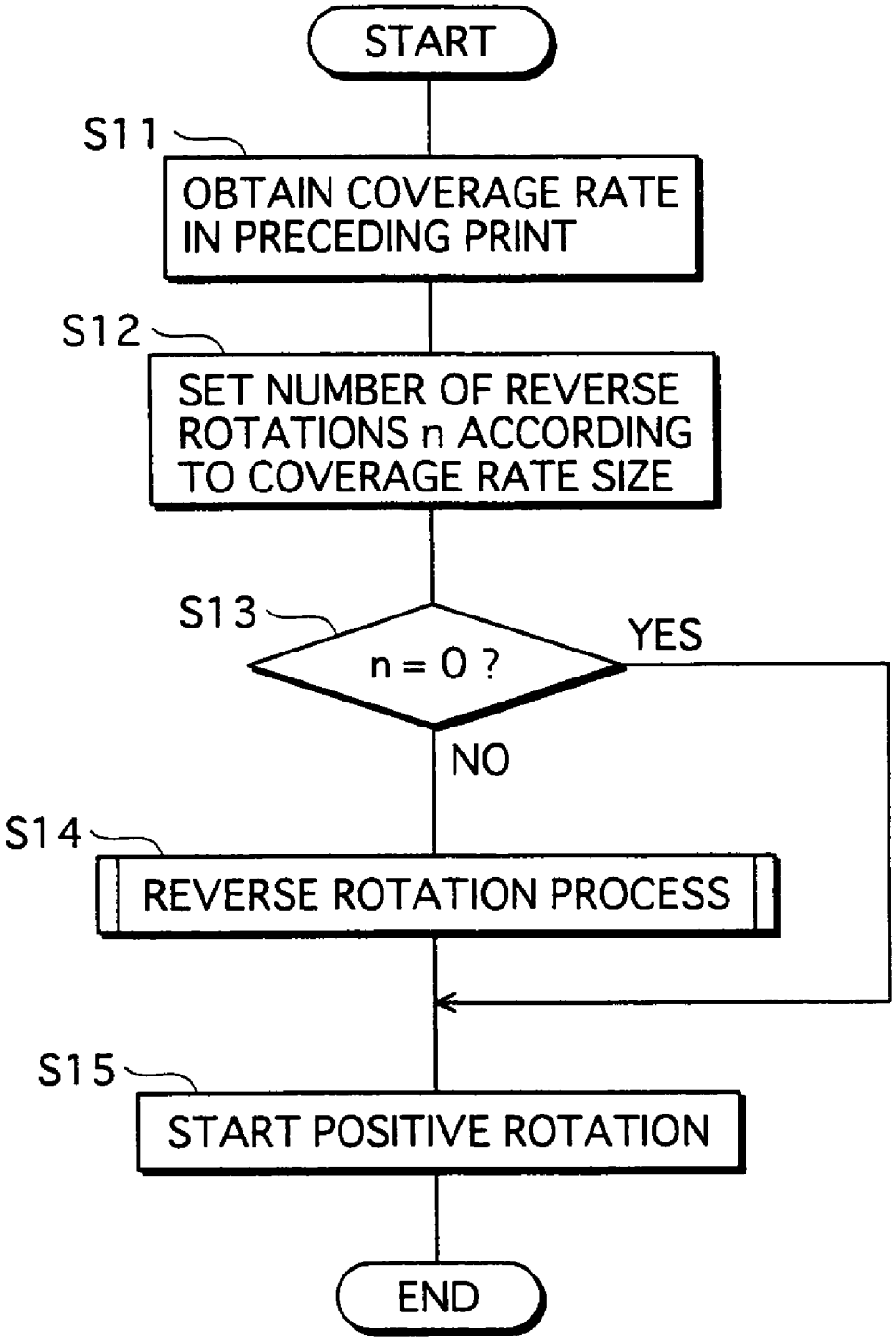
FIG. 4 is a flowchart showing the procedures of the motor drive control process performed by the motor control unit 103 of the control unit 100.

As shown in FIG. 4, first the coverage rate P in the preceding print is obtained (step S11). Here, the coverage rate information is read out from the coverage rate information storage unit 106. It should be noted here that if coverage rate values are stored as history information, the latest value (value of the preceding image forming), or the smallest value or an average value among a predetermined number of image forming operations in the past may be used as the coverage rate.

The number of reverse rotations "n" is set in accordance with the size of the coverage rate (step S12). More specifically, the reverse rotation information table 201 is referred to and the number of reverse rotations corresponding to the coverage rate P is readout. For example, if the coverage rate P is 0.5[%], the number of reverse rotations is set to "0" (the reverse rotation is prohibited).

In the next step, it is judged whether or not the number of reverse rotations is "0" (step S13).

If it is judged that the number of reverse rotations is not "0" ("NO" in step S13), the reverse rotation process is performed (step S14).

Figure 5:
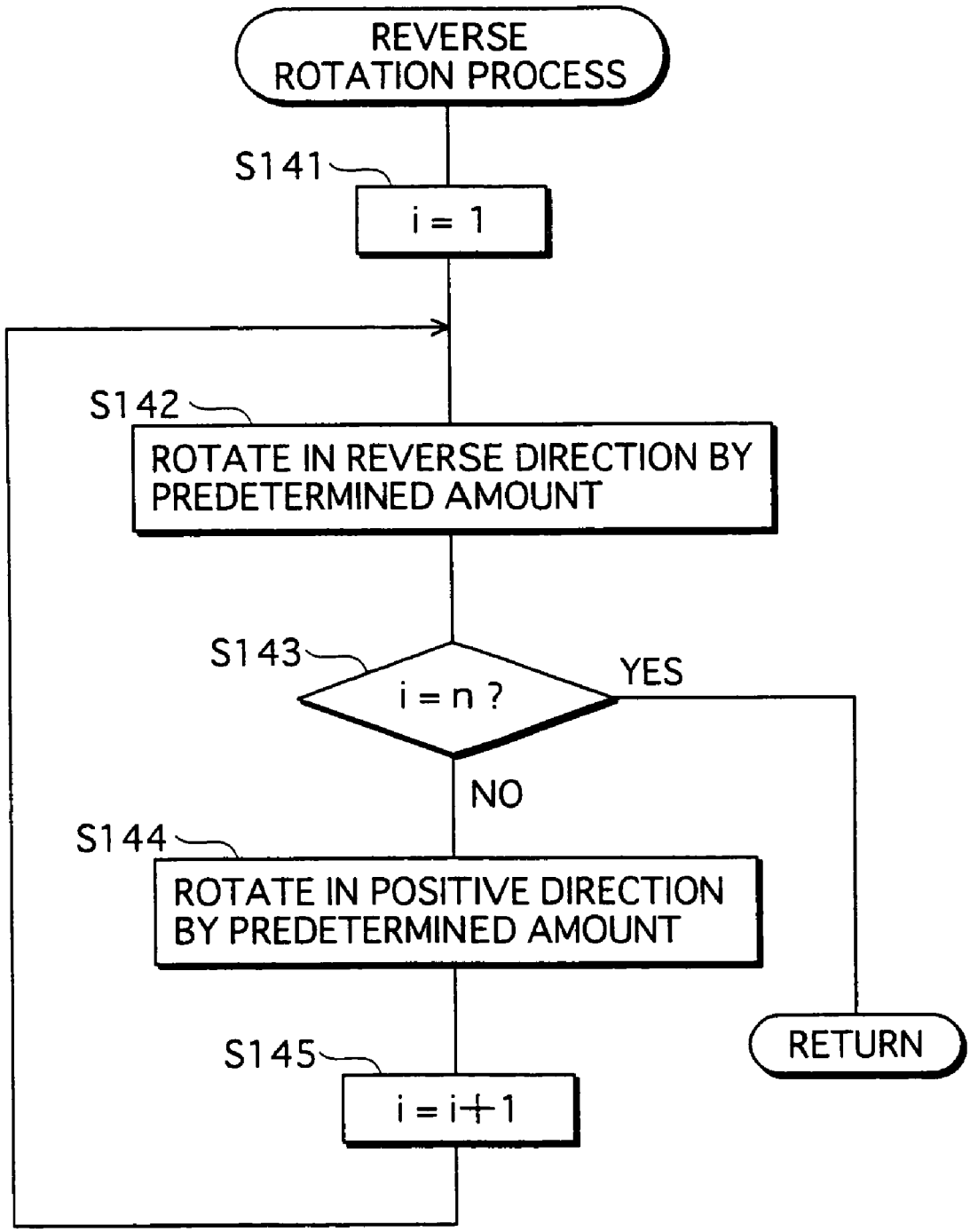
FIG. 5 is a flowchart showing the procedures of a sub routine for the reverse rotation process.

FIG. 5 is a flowchart showing the procedures of a sub routine for the reverse rotation process.

As shown in FIG. 5, first a variable i is set to "1" (step S141). Then, a current for the reverse rotation is supplied to the drum drive motor 9 and the belt drive motor 15 so that the photosensitive drum 3 and the intermediate transfer belt 11 are rotated in the reverse direction by a predetermined amount (step S142). It should be noted here that the values of the predetermined amount and the reverse rotation speed (for example, values of the time and distance of the reverse rotation) are, as is the case with the number of reverse rotations, determined preliminarily from experiments and the like, to be optimum values in the range in which the foreign objects such as paper powder that remain under the cleaning blade edge can be removed effectively and the inverse warpage of the blade does not occur, and the determined values are stored in a storage unit (not illustrated). For example, the photosensitive drum 3 and the intermediate transfer belt 11 may be rotated in the reverse direction by 5 [mm] and 10 [mm], respectively.

When the reverse rotation of the predetermined amount is completed (when they stop), it is judged whether or not the variable i is equal to the number of reverse rotations n (step S143).

If it is judged that the variable i is not equal to the number of reverse rotations n ("NO" in step S143), a current for the positive rotation is supplied to the drum drive motor 9 and the belt drive motor 15 so that the photosensitive drum 3 and the intermediate transfer belt 11 are rotated in the positive direction by a predetermined amount (step S144). It should be noted here that the values of the predetermined amount and the positive rotation speed are determined preliminarily and stored in a storage unit (not illustrated). These values may be the same as the values for the reverse rotation, or larger or smaller than the values for the reverse rotation.

When the positive rotation of the predetermined amount is completed (when they stop), the variable i is incremented by "1" (step S145), and the control returns to step S142.

After this, the steps S142 and S143 are performed. That is to say, the reverse rotation of the predetermined amount is performed and it is judged whether or not the variable i is equal to the number of reverse rotations n.

These steps are repeated until it is judged that the variable i is equal to the number of reverse rotations n ("YES" in step S143), and then the control returns to the main routine for the motor drive control process.

In the above-described operation, for example, when the number of reverse rotations n is set to "1", the reverse rotation of the photosensitive drum 3 and the intermediate transfer belt 11 by the predetermined amount is performed once. Also, when the number of reverse rotations n is set to "2", the rotation operation is performed as follows: the reverse rotation of the predetermined amount, the positive rotation of the predetermined amount, and the reverse rotation of the predetermined amount.

Back to FIG. 4, in step S15, the photosensitive drum 3 and the intermediate transfer belt 11 are started to be rotated in the positive direction to start the printing operation, and this completes the process.

If it is judged in step S13 that the number of reverse rotations is "0" ("YES" in step S13), the control moves to step S15. In this case, the photosensitive drum 3 and the intermediate transfer belt 11 are started to be rotated in the positive direction without being rotated in the reverse direction.

As described up to now, in the present embodiment, whether to perform the reverse rotation and the number of reverse rotations are determined according to the size of the coverage rate in the preceding print job. This makes it possible to prevent the inverse warpage from occurring since the reverse rotation is prohibited or the number of reverse rotations is restricted if the possibility of occurrence of the inverse warpage is high. Also, according to the present embodiment, if the possibility of occurrence of the inverse warpage is low, the number of reverse rotations is increased so as to remove foreign objects such as paper powder from between the cleaning blade and the photosensitive drum 3 and the intermediate transfer belt 11, and prevent the toners and the like from passing through spaces between the foreign objects, thereby improving the cleaning performance.

It should be noted here that the method for controlling the reverse rotation is not limited to the above-described one using the table showing correspondence between the coverage rate and the number of reverse rotations, but other methods may be used in so far as they control the reverse rotation according to the information that indicates the obtained coverage rate. For example, a formula may be used to derive the number of reverse rotations from the coverage rate. This also applies to various controls on the reverse rotation which will be described later.

Second Embodiment

In the First Embodiment, the reverse rotation is controlled according to the size of the coverage rate. In the Second Embodiment, the reverse rotation is controlled according to the internal temperature of the device. This is the difference from the First Embodiment. In the following description of the Second Embodiment, explanation of the contents that have already been explained in the First Embodiment is omitted, with the same reference numbers given to constituents that are common to both embodiments.

Figure 7:
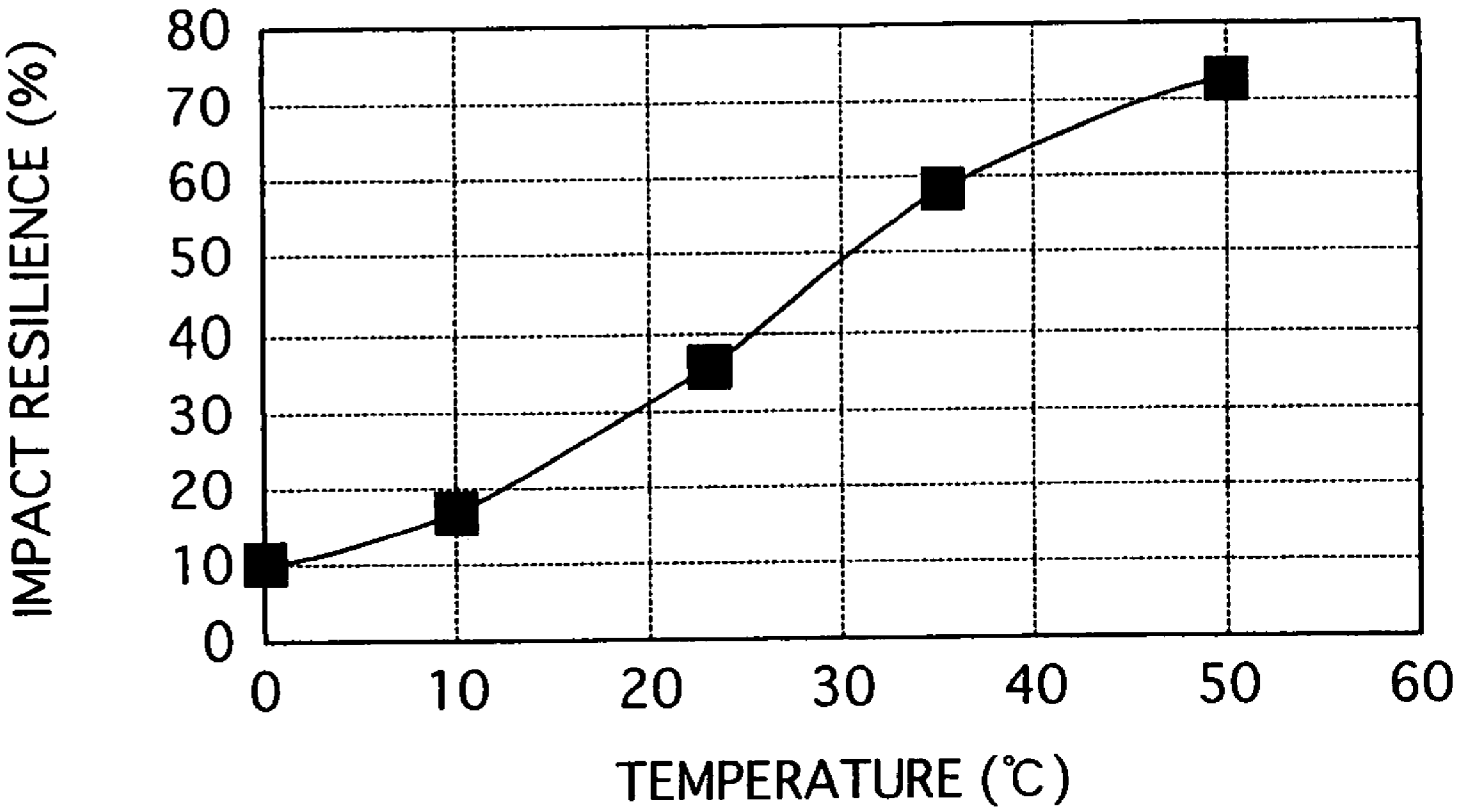
FIG. 7 shows an example of the relationships between the impact resilience of the cleaning blade and the temperature.

FIG. 6 shows the contents of a reverse rotation information table 202 stored in the reverse rotation information storage unit 104. FIG. 7 shows a specific example of the relationships between the impact resilience of the cleaning blade and the temperature.

As shown in FIG. 6, the reverse rotation information table 202 shows the correspondence between the internal temperature of the device and the number of reverse rotations. The table shown in FIG. 6 indicates that the number of reverse rotations increases as the internal temperature of the device decreases, and that the number of reverse rotations decreases as the internal temperature of the device increases. As is the case with the First Embodiment, these arrangements are provided in order to prevent the inverse warpage of the cleaning blade.

The reasons for these arrangements are as follows. The cleaning blade is made of urethane rubber or the like. As shown in FIG. 7, the material has a property of becoming softer and increasing in the impact resilience as the temperature increases. And when the temperature is higher, the contact area of the cleaning blade with the photosensitive drum 3 is larger. That the contact area increases means that the frictional force between the cleaning blade and the photosensitive drum 3 increases as much, and the possibility of occurrence of the inverse warpage increases as well.

It should be noted here that the values of internal temperature of the device and the number of reverse rotations are not limited to those shown in FIG. 6, but may be determined preliminarily from experiments and the like, to be optimum values, as is the case with the First Embodiment. This similarly applies to the reverse rotation information in the modifications and the like that will be described later.

Figure 8:
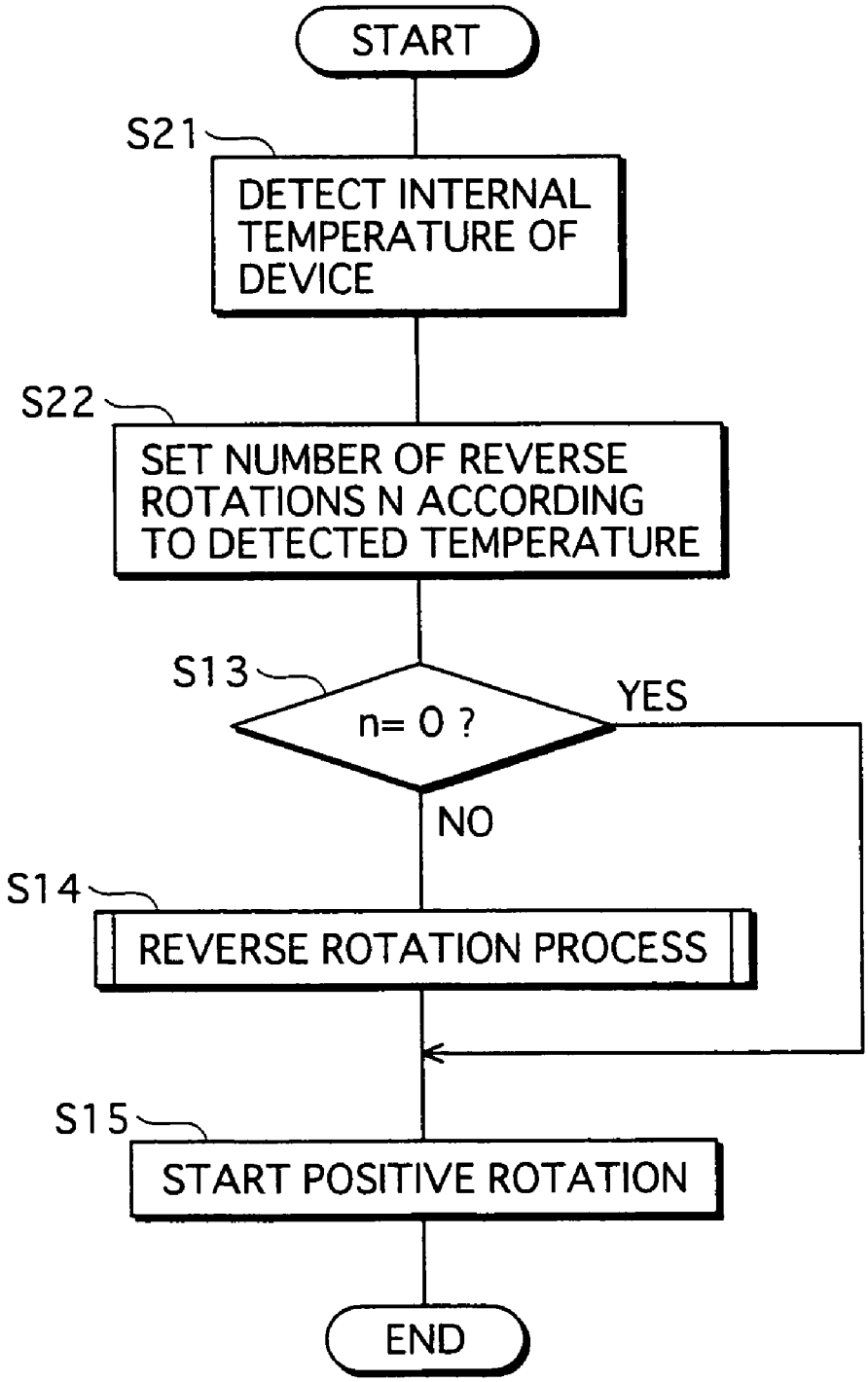
FIG. 8 is a flowchart showing the procedures of the motor drive control process in the Second Embodiment.

FIG. 8 is a flowchart showing the procedures of the motor drive control process in the present embodiment. The process is performed when a printing operation is started upon reception of a request to execute a print job.

As shown in FIG. 8, the procedures of the motor drive control process in the present embodiment is basically the same as those in the First Embodiment, but differ therefrom in that steps S21 and S22 are performed instead of steps S11 and S12.

In step S21, a detection signal is received from the temperature detect sensor 18, and detects (obtains) the internal temperature of the device. In step S22, the number of reverse rotations "n" is set in accordance with the detected internal temperature of the device. More specifically, the reverse rotation information table 202 is referred to and the number of reverse rotations corresponding to the detected internal temperature of the device is read out. For example, if the detected internal temperature of the device is 31[° C.], the number of reverse rotations is set to "0".

The remaining steps starting with step S13 are the same as in the First Embodiment, and in these steps, the reverse rotation and the like are performed according to the set number of reverse rotations "n", and then the positive rotation is started to start printing.

As described above, it is possible to control the reverse rotation of the photosensitive drum 3 and the like in correspondence with the detected internal temperature of the device, so as to prevent the inverse warpage of the cleaning blade. Also, a temperature detecting sensor having been provided for another purpose may be used for the reverse rotation control. This is cost-effective since there is no need to install a new sensor.

Third Embodiment

The present embodiment differs from the above-described embodiments in that the pressing force applied to the cleaning blade is variable.

Figure 9B:
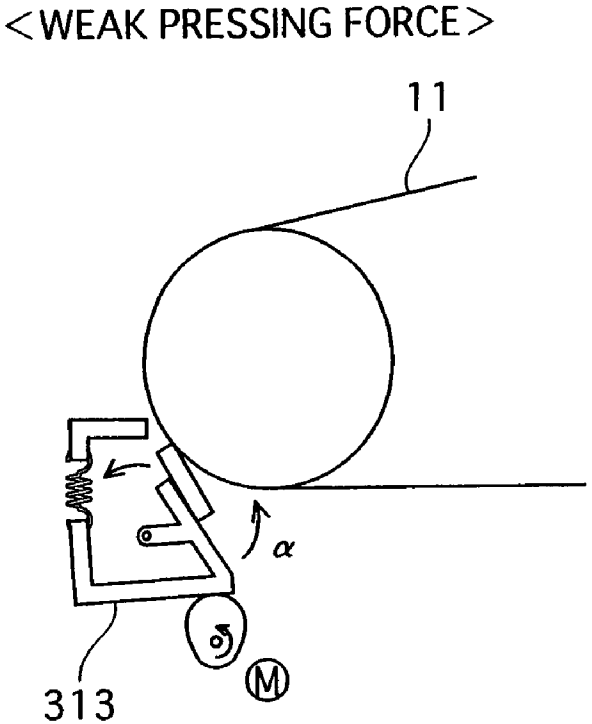
FIGS. 9A and 9B show the construction of a belt cleaning unit 301 in the Third Embodiment.
Figure 9A:
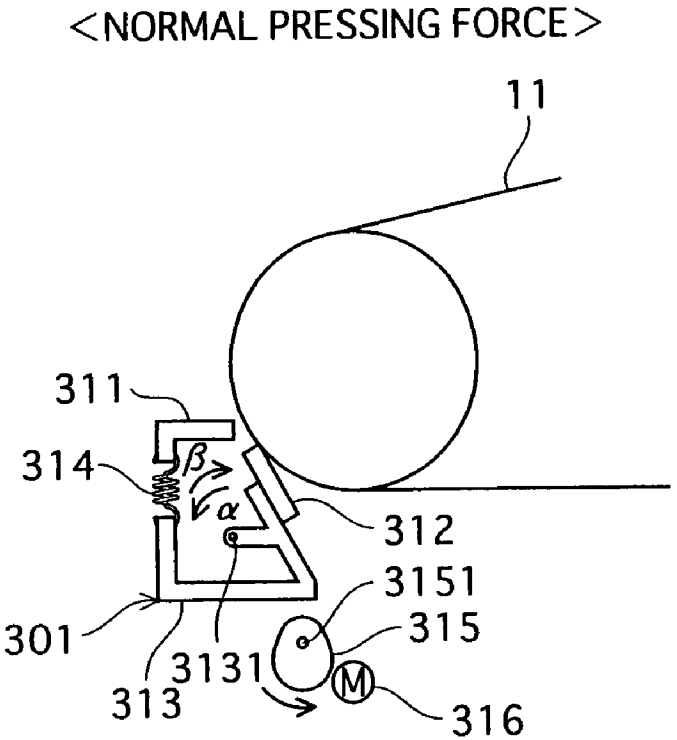

FIGS. 9A and 9B show the construction of a belt cleaning unit 301 in the present embodiment. FIG. 9A shows the state in which the cleaning blade is contacted with a normal pressing force, and FIG. 9B shows the state in which the cleaning blade is contacted with a weak pressing force.

As shown in FIGS. 9A and 9B, the belt cleaning unit 301 includes a frame 311, a cleaning blade 312, a blade supporting member 313, a pulling spring 314, a cam 315, and a cam drive motor 316.

The frame 311 is fixed to a base or the like (not illustrated) of the device.

The cleaning blade 312 is attached to the blade supporting member 313, and the edge is contacted with the surface of the intermediate transfer belt 11.

The blade supporting member 313 is held such that it can rotate freely in the direction indicated by the arrow α or in the inverse direction indicated by the arrow β in FIGS. 9A and 9B, around a supporting point 3131 as the rotation axis. The blade supporting member 313 is connected to the frame 311 via the pulling spring 314 such that the blade supporting member 313 is always biased in the direction in which the cleaning blade 312 is pressed to the intermediate transfer belt 11 (in the arrow β direction), by the biasing force given by the pulling spring 314.

The cam 315 is linked to the rotation axis of the cam drive motor 316, and is driven by the cam drive motor 316 to rotate around a rotation axis 3151.

When the cam 315 is in the home position (first position) as shown in FIG. 9A, the circumferential surface of the cam 315 is not contacted with the blade supporting member 313, and the cleaning blade 312 is pressed to the intermediate transfer belt 11 by a normal pressure (first pressing force) being the biasing force given by the pulling spring 314.

As the cam 315 starts to rotate, the circumferential surface of the cam 315 comes to contact with the blade supporting member 313, and gradually raises the blade supporting member 313. This causes the blade supporting member 313 to rotate in the arrow α direction. As this rotation proceeds, the biasing force given by the pulling spring 314 is gradually weakened. The pressing force applied to the cleaning blade 312 is gradually weakened from the first pressing force. When the rotated cam 315 comes to a weak-pressure position (second position) as shown in FIG. 9B, the weakest pressing force (second pressing force) is applied to the cleaning blade 312.

The belt cleaning unit 301 is provided with a sensor (not illustrated) for detecting whether the cam 315 is in the home position or in the weak-pressure position. The motor control unit 103 in the present embodiment grasps the position of the cam 315 by a detection signal sent from the sensor.

In the motor drive control process, the motor control unit 103 supplies a current to the cam drive motor 316 to control the rotation of the cam 315, thereby changing the pressing force applied to the cleaning blade.

Figure 10:
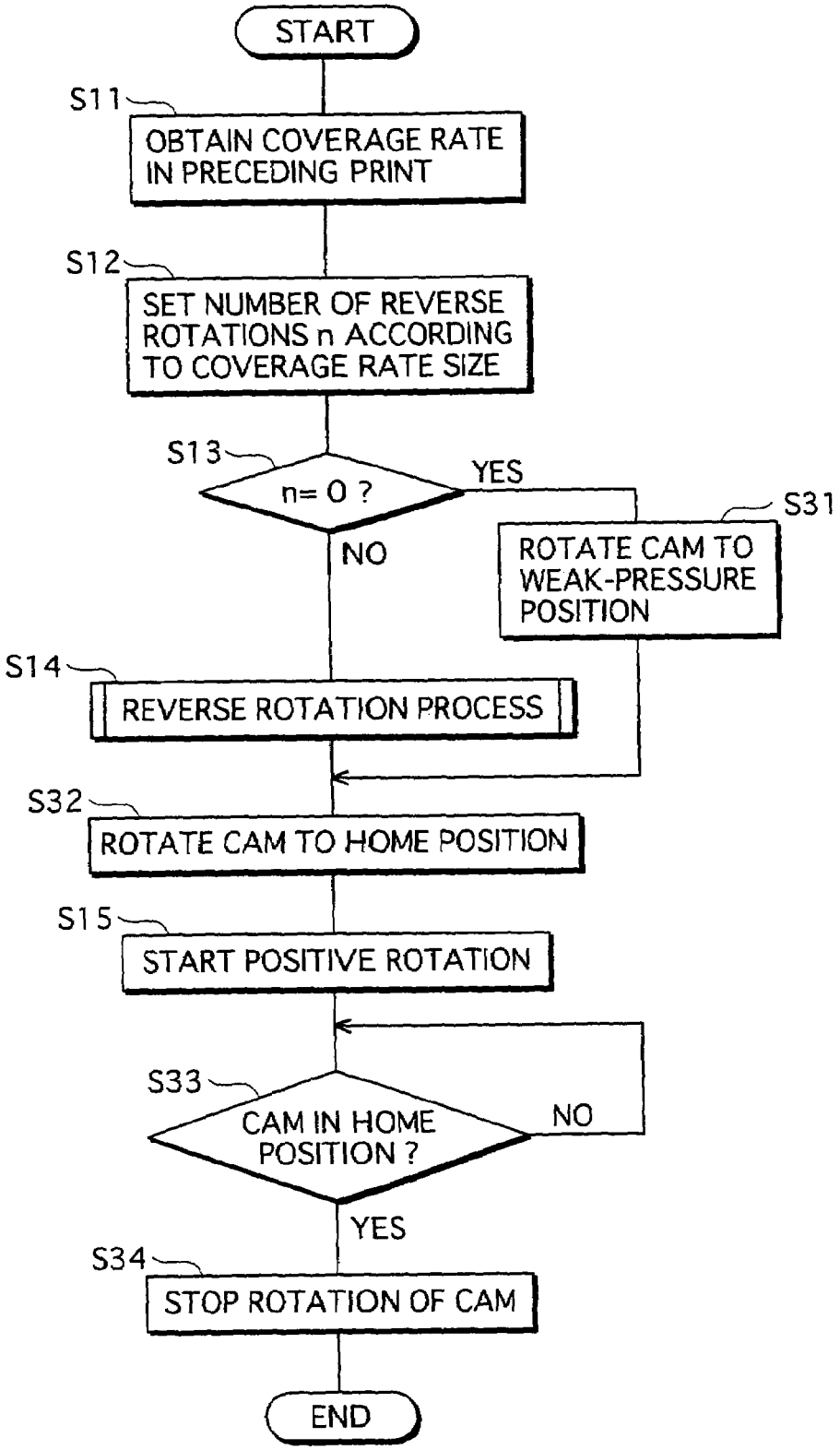
FIG. 10 is a flowchart showing the procedures of the motor drive control process in the Third Embodiment.
Figure 11:
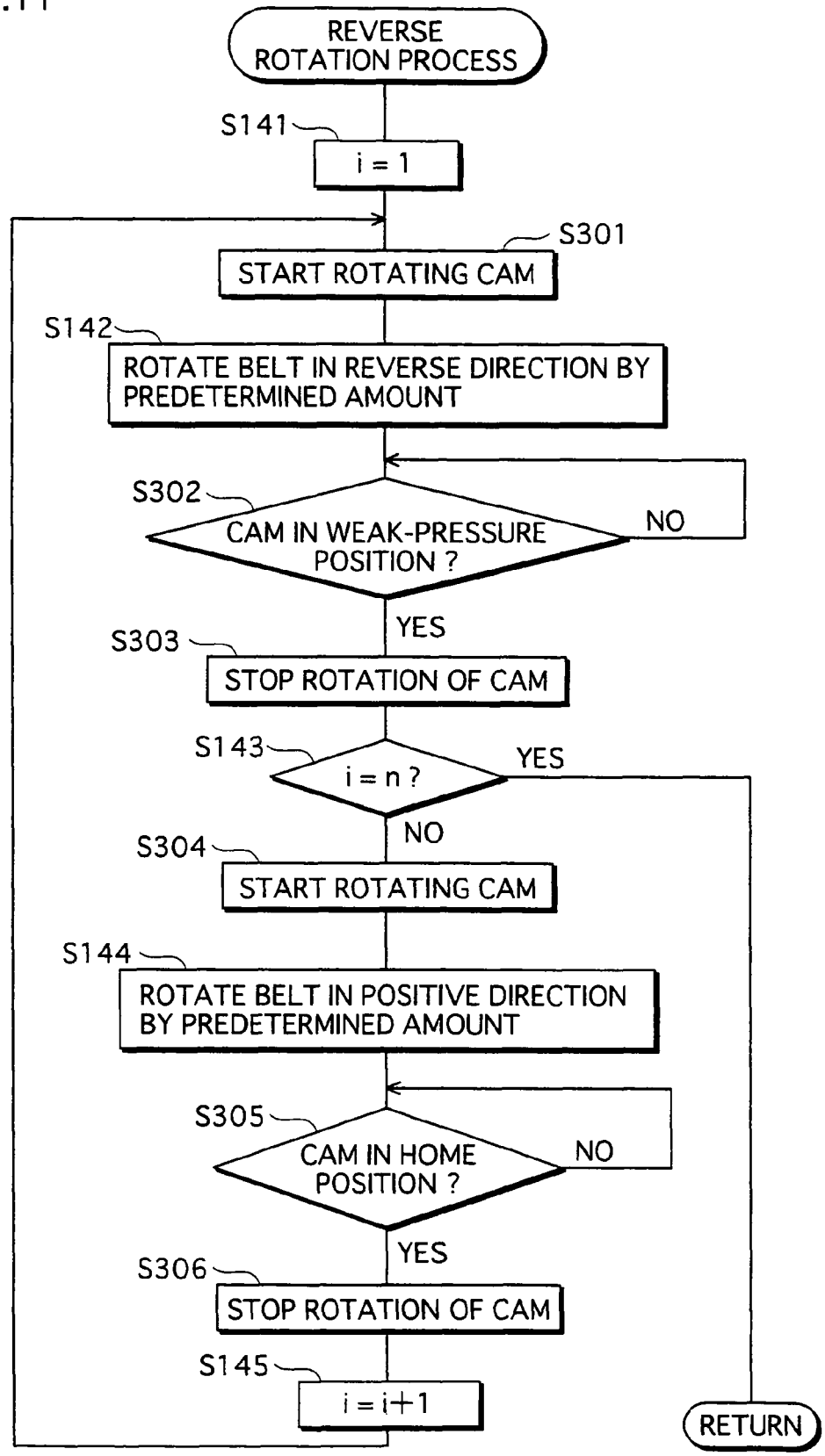
FIG. 11 is a flowchart showing the procedures of the reverse rotation process in the Third Embodiment.

FIGS. 10 and 11 are flowcharts showing the procedures of the motor drive control process and the reverse rotation process.

As shown in FIG. 10, the motor drive control process in the present embodiment is basically the same as in the First Embodiment, but differs in that steps S31 and S32 have been inserted between steps S13 and S15, and steps S33 and S34 have been inserted after step S15.

Also, in the sub routine for the reverse rotation process shown in FIG. 11, step S301 has been inserted between steps S141 and S142, and steps S302 and S303 have been inserted between steps S142 and S143. Also, step S304 has been inserted between steps S143 and S144, and steps S305 and S306 have been inserted between steps S144 and S145.

Here, first the sub routine for the reverse rotation process, and then the main routine for the motor drive control process will be described, for the sake of convenience.

As shown in FIG. 11, first a variable i is set to "1" (step S141). Then, the cam drive motor 316 is controlled to start rotating the cam 315 (step S301). Here, it is presumed that the cam 315 is in the home position.

The intermediate transfer belt 11 is rotated in the reverse direction by a predetermined amount immediately after the cam 315 is started to be rotated (step S142). Then it is judged whether the rotating cam 315 has reached the weak-pressure position (step S302). If it is judged that the rotating cam 315 has reached the weak-pressure position ("YES" in step S302), the rotation of the cam 315 is stopped (step S303).

As described above, as the cam 315 rotates from the home position to the weak-pressure position, the pressing force applied to the cleaning blade gradually decreases from the normal pressure to the weakest pressing force. The intermediate transfer belt 11 is rotated in the reverse direction while the pressing force applied to the cleaning blade gradually decreases. With this arrangement, the pressing force applied to the paper powder and the like that are present between the cleaning blade 312 and the intermediate transfer belt 11 is reduced, thereby making the paper powder and the like easy to remove and improving the dust removing performance.

If it is judged that the variable i is not equal to the number of reverse rotations n ("NO" in step S143), the rotation of the cam 315 is resumed from the weak-pressure position (step S304). The intermediate transfer belt 11 is rotated in the positive direction by a predetermined amount immediately after the rotation of the cam 315 is resumed (step S144). It is then judged whether or not the rotating cam 315 has reached the home position (step S305). If it is judged that the rotating cam 315 has reached the home position ("YES" in step S305), the rotation of the cam 315 is stopped (step S306).

As described up to now, in the present embodiment, as the cam 315 rotates from the weak-pressure position to the home position, the pressing force applied to the cleaning blade gradually increases from the weakest pressing force to the normal pressure. The intermediate transfer belt 11 is rotated in the positive direction while the pressing force applied to the cleaning blade gradually increases. Since the positive rotation is started when the pressing force is weak, it is possible to further prevent the inverse warpage of the cleaning blade 312.

After the rotation of the cam 315 is stopped in step S306, the variable i is incremented by "1" (step S145) and the control returns to step S301.

After this, step S301 and the succeeding steps are performed. That is to say, the pressing force applied to the cleaning blade 312 gradually decreases while the intermediate transfer belt 11 is rotated in the reverse direction, and the positive rotation is started when the pressing force is weakest, and the pressing force gradually increases while the intermediate transfer belt 11 is rotated in the positive direction.

If it is judged that the variable i is equal to the number of reverse rotations n ("YES" in step S143), the control returns to the main routine for the motor drive control process. In the motor drive control process, as shown in FIG. 10, after the reverse rotation process in step S14 is ended, the cam 315 is rotated from the weak-pressure position to the home position in step S32. Then the intermediate transfer belt 11 is started to be rotated in the positive direction in step S15. It is judged whether or not the rotating cam 315 has reached the home position (step S33). If it is judged that the rotating cam 315 has reached the home position ("YES" in step S33), the rotation of the cam 315 is stopped (step S34), and the process is ended. The reverse rotation process ends with the cam 315 being in the weak-pressure position. Therefore, step S32 is performed to return the cam 315 to the home position before the intermediate transfer belt 11 is started to be rotated in the positive direction in step S15. With this arrangement, the intermediate transfer belt 11 is started to be rotated in the positive direction when the pressing force is weak, and it is possible to further prevent the inverse warpage of the cleaning blade 312.

If it is judged that the number of reverse rotations n is "0" ("YES" in step S13), the cam 315 is rotated to the weak-pressure position (step S31), and the control returns to step S32. The cam 315 usually is in the home position. Therefore, when the reverse rotation process (in which the cam 315 is rotated to the weak-pressure position in steps S301-S303) is not performed, the cam 315 needs to be rotated to the weak-pressure position to weaken the pressing force. Then the intermediate transfer belt 11 is started to be rotated in the positive direction, and during the positive rotation (steps S32-S34), the pressing force is gradually increased.

As described above, using the construction in which the pressing force applied to the cleaning blade 312 is variable, it is possible to remove the paper powder and the like and to further improve the effect of preventing the inverse warpage of the cleaning blade 312. Also, in this construction, the pressing force applied to the cleaning blade 312 does not become zero, namely, the cleaning blade 312 does not separate from the intermediate transfer belt 11. This construction prevents paper powder and the like from dropping off the belt cleaning unit 301 and scattering inside the device.

The values of the size, increase/decrease speed, time and the like of the pressing force (the shape, rotation speed and the like of the cam 315) are determined preliminarily from experiments and the like, to be optimum values in the range in which paper powder and the like can be removed effectively and the inverse warpage of the cleaning blade does not occur, taking into accounts the materials of the cleaning blade 312 and the intermediate transfer belt 11, the rotation speed of the intermediate transfer belt 11 in the positive/reverse direction and the like.

In the above description, the cam 315 is used as an example to make the pressing force variable. However, not limited to this, any other construction may be used in so far as it can make the pressing force variable. For example, solenoid can be used for this purpose.

Figure 12B:
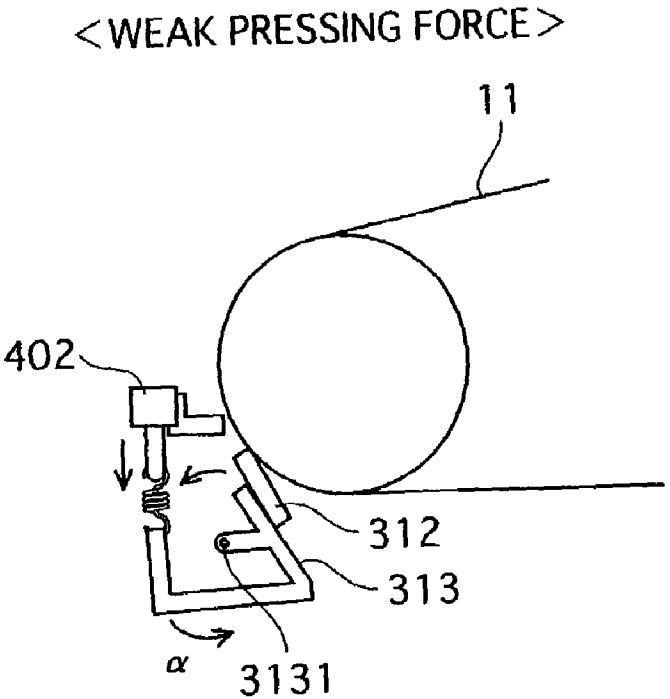
FIGS. 12A and 12B show the construction of a cleaning unit 401 using solenoid.
Figure 12A:
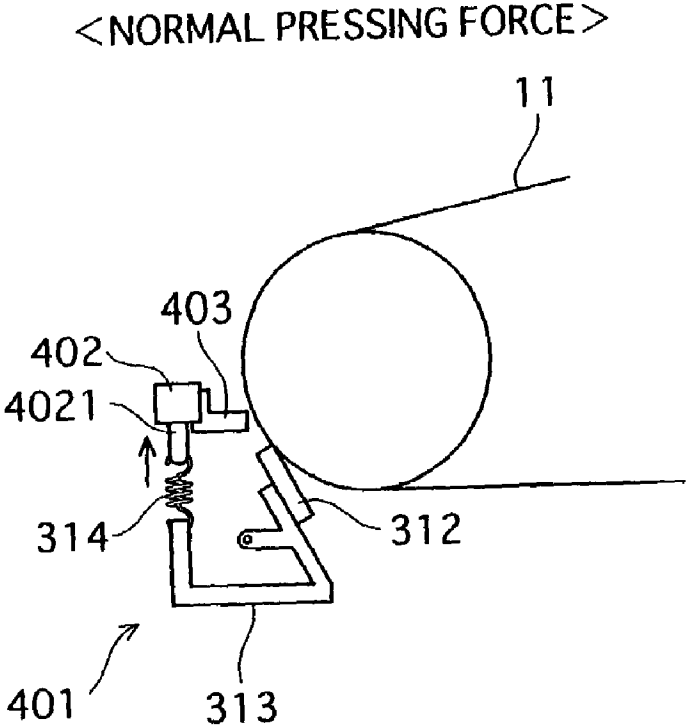
Figure 16A:
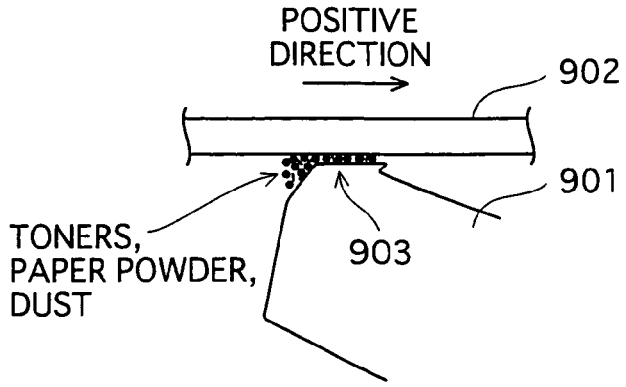
FIGS. 16A to 16D illustrate an inverse warpage of the cleaning blade.
Figure 16B:
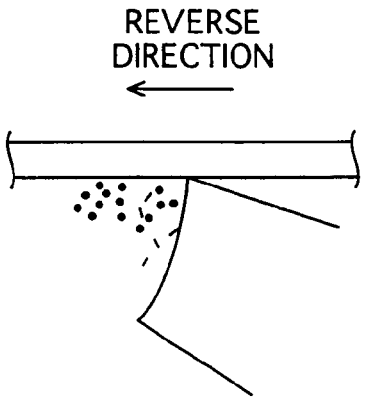
Figure 16C:
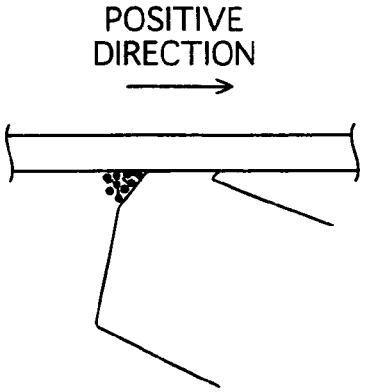
Figure 16D:
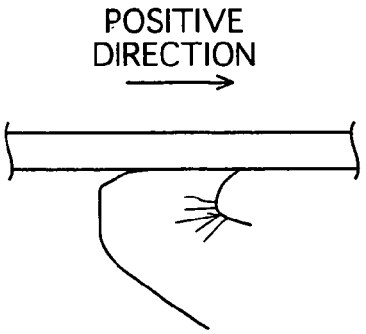

FIGS. 12A and 12B show the construction of a cleaning unit 401.

As shown in FIGS. 12A and 12B, the cleaning unit 401 is provided with a solenoid 402 instead of the cam 315 and the cam drive motor 316. The solenoid 402 is fixed to a frame 403, and a plunger 4021 is connected to the blade supporting member 313 via the pulling spring 314.

When the normal pressing force is applied, as shown in FIG. 12A, the plunger 4021 of the solenoid 402 is pulled in and the pulling spring 314 is pulled up, and a first pressing force is applied and the cleaning blade 312 is pressed onto the intermediate transfer belt 11. On the other hand, when a weak pressing force is applied, as shown in FIG. 12B, the plunger 4021 of the solenoid 402 is pushed out and the pulling spring 314 is compressed, and the blade supporting member 313 rotates around a supporting point 3131 in the direction indicated by the arrow $\alpha$ as much as the pulling spring 314 is compressed. This weakens the pressing force applied to the cleaning blade 312, to a second pressing force weaker than the first pressing force.

As apparent from the above description, the solenoid 402 can be used to make the pressing force variable.

In the above-described example, the control for making the pressing force variable is applied to the cleaning unit of the intermediate transfer belt 11. However, not limited to this, the control may be applied to the drum cleaning unit 8 of the photosensitive drum 3.

The present invention is not limited to the image forming device, but may be a method of processing the reverse rotation of the photosensitive drum or the intermediate transfer belt. The present invention may further be a program for causing a computer to execute the method. The program of the present invention may be recorded on various computer-readable recording mediums such as: magnetic tape; a magnetic disk such as a flexible disk; an optical recording medium such as DVD-ROM, DVD-RAM, CD-ROM, CD-R, MO, or PD; and a flash-memory-type recording medium. The present invention may be produced or transferred in the form of the above-mentioned recording medium, or may be sent or supplied in the form of the above-mentioned program via: one of various wired/wireless networks including the Internet; a broadcast; an electric communication line; a satellite communication or the like.

It is not necessary for the program of the present invention to include all the modules for the above-described processes to be executed by the computer. For example, part of the processes of the present invention to be executed by the computer may be achieved by general-purpose programs that can be installed in an information processing device, such as the programs contained in a communication program or an operating system (OS). Accordingly, the recording medium of the present invention does not necessarily record all the above-mentioned modules, nor is it necessary to send all the modules. Furthermore, predetermined processes of the present invention may be executed using dedicated hardware.

Modifications

Up to now, the present invention has been described specifically through embodiments. However, the present invention is not limited to the above-described embodiments, but may be modified variously as the following shows.

(1) In the above-described embodiments, the internal temperature of the device (environmental condition) or the coverage rate is obtained as information indicating an index of the size of the frictional force that is generated between the cleaning blade and the rotating photosensitive drum/intermediate transfer belt. And the number of reverse rotations, as the target of the reverse rotation control, is then determined in accordance with the information. However, the index information or the reverse rotation control target of the present invention is not limited to the above-described one.

For example, the index information may be the number of prints, and the reverse rotation control target may be the reverse rotation distance.

FIG. 13 shows an example of the construction of a reverse rotation information table 203 in the present modification, where the table shows correspondence between the total number of prints and the distance of the reverse rotation.

Here, the total number of prints indicates a cumulative value (total) of the number of prints (the number of image forming operations) since a new cleaning blade was attached. The reverse rotation distance indicates a moving distance on the surface of the photosensitive drum 3 or the intermediate transfer belt 11 in a reverse rotation. In the example shown in FIG. 13, the distance of reverse rotation is 0 [μm] (the reverse rotation is prohibited) when the total number of prints is 500 or less; and the reverse rotation distance is increased as the total number of prints increases in the excess of 500.

The reason why the reverse rotation is prohibited when the number of prints is 500 or less is as follows. When the number of prints is 500 or less, the cleaning blade is almost new and has hardly become worn, and the frictional force between the cleaning blade and the rotating photosensitive drum/intermediate transfer belt is large. There is high probability of occurrence of inverse warpage when the reverse rotation is performed in such a state. In addition, when the cleaning blade is almost new, the amount of paper powder and the like that is present between the cleaning blade and the photosensitive drum 3 is small, and there is low probability of occurrence of defective cleaning even if the reverse rotation is not performed.

The reason why the reverse rotation distance is increased as the total number of prints increases is as follows. As the number of prints increases, the amount of wear of the cleaning blade increases, reducing the frictional force to some extent. In such a state, if the reverse rotation distance is increased, the inverse warpage is difficult to occur. In addition, the amount of paper powder and the like increases as the number of prints increases.

The reverse rotation operation is performed according to the information shown by the reverse rotation information table 203. More specifically, for example, the reverse rotation is not performed if the total number of prints is 100; and the photosensitive drum 3 and the intermediate transfer belt 11 are rotated in the reverse direction by 10 [mm] before the positive rotation if the total number of prints is 11,000. It should be noted here that the value of the total number of prints is updated each time a printing operation onto the sheet S is performed, where the updating consist of the operation of adding the number of prints for the printing operation to the current value of the total number of prints and storing the result of the addition as the new value of the total number of prints.

(2) The index information may be the total rotation time, and the reverse rotation control target may be the reverse rotation time.

FIG. 14 shows an example of the construction of a reverse rotation information table 204 in the present modification, where the table shows correspondence between the total rotation time and the reverse rotation time.

Here, the total rotation time indicates a total driving time of the photosensitive drum 3 (the intermediate transfer belt 11) since a new cleaning blade was attached. The reverse rotation time is a time during which the photosensitive drum 3 (the intermediate transfer belt 11) is rotated in the reverse direction. In the present modification, different rotation controls are performed onto the photosensitive drum 3 and the intermediate transfer belt 11, respectively.

More specifically, for example, when the total rotation time of the photosensitive drum 3 is 20 minutes, the photosensitive drum 3 is not rotated in the reverse direction. As another example, when the total rotation time of the intermediate transfer belt 11 is 5 hours, the intermediate transfer belt 11 is rotated in the reverse direction for 0.5 seconds. Accordingly, the values of the driving time are updated differently for each of the photosensitive drum 3 and the intermediate transfer belt 11.

The reason why the reverse rotation time is increased as the total rotation time increases is for the same reason as the above-described example in which the total number of prints and the reverse rotation distance are used.

(3) The index information may be the preceding print mode, and the reverse rotation control target may be the reverse rotation acceleration.

FIG. 15 shows an example of the construction of a reverse rotation information table 205 in the present modification, where the table shows correspondence between the preceding print mode and the reverse rotation acceleration.

Here, the preceding print mode indicates a print mode in which the preceding print job (image formation job) was executed. FIG. 15 shows five modes such as "single-side continuous, 3 sheets or less". The "single-side" indicates a mode in which the printing is performed only onto one side of the sheet, while the "both side" indicates a mode in which the printing is performed onto both sides of the sheet. Although in the actuality, other modes, for example, a mode in which the single-side mode and the both side mode are combined, may be provided, but description of such other modes is omitted here.

The reverse rotation acceleration indicates a value of the acceleration that is performed during a predetermined time period after the start of the reverse rotation. That the value of the acceleration is large indicates that the rotation speed after the predetermined time period is high, and that the effect of removing the paper powder and the like is large as much, but that conversely, there is high probability of occurrence of inverse warpage.

In the case of the example shown in FIG. 15, a small value of the reverse rotation acceleration is assigned to the mode "single-side continuous, 3 sheets or less". This arrangement is made for the following reason. It is assumed that the amount of toner, toner additive and the like that are present between the cleaning blade 81 and the photosensitive drum 3, and between the cleaning blade 191 and the intermediate transfer belt 11 is small in this mode, and such a small value of the reverse rotation acceleration is assigned in preference of preventing the inverse warpage from occurring.

When the number of prints is 200 or more in the preceding mode, it is assumed that a large amount of toner, toner additive and the like, which play a role of a lubricant agent, are present, and that the inverse warpage is difficult to occur. In such a case, a large value of the reverse rotation acceleration is assigned so as to increase the effect of removing the paper powder and the like.

In the example shown in FIG. 15, it is presumed that the preceding print job performs a continuous printing (a mode in which an image formation job performs a plurality of image forming operations continuously). Not limited to this, the reverse rotation may be prohibited or a value smaller than the smallest value shown in FIG. 15 may be assigned as the reverse rotation acceleration value in correspondence with the case where in the preceding print mode, an image formation job performs one print (image forming operation) onto one sheet.

(4) The combinations of the index information and the reverse rotation control target are not limited to the above-described ones, but other combinations are possible. For example, when the coverage rate is used as the index information, the reverse rotation distance may be used as the reverse rotation control target. In this case, the values may be set so that the reverse rotation distance increases as the coverage rate increases, and that the reverse rotation is prohibited when the coverage rate is less than a predetermined value.

Similarly, when the internal temperature of the device is used as the index information, the reverse rotation distance may be used as the reverse rotation control target. In this case, the values may be set so that the reverse rotation distance increases as the internal temperature of the device decreases, and that the reverse rotation is prohibited when the internal temperature of the device is higher than a predetermined value. Also, when the internal temperature of the device is used as the index information, the reverse rotation time may be used as the reverse rotation control target. In this case, the values may be set so that the reverse rotation time increases as the internal temperature of the device decreases.

Further, when the total number of prints is used as the index information, the number of reverse rotations may be used as the reverse rotation control target. In this case, the values may be set so that the number of reverse rotations increases as the total number of prints increases, and that the reverse rotation is prohibited when the total number of prints is less than a predetermined value.

Also, when the total number of prints is used as the index information, the reverse rotation time may be used as the reverse rotation control target. In this case, the values may be set so that the reverse rotation time increases as the total number of prints increases.

(5) Similarly, for example, the index information may be the total number of prints since the preceding reverse rotation, or the total driving (rotation) time of the photosensitive drum 3 (the intermediate transfer belt 11) since the preceding reverse rotation. In these cases also, the values may be set so that the reverse rotation time or the number of reverse rotations increases as the total number of prints or the total driving time increases, and that the reverse rotation is prohibited when the value of the index information is less than a predetermined value.

Further, the reverse rotation may be controlled by referring to a time elapsed from the preceding job. For example, if a job has not been executed for a long time since the preceding job, toners and the like, which are present between the cleaning blade and the intermediate transfer belt 11 (the photosensitive drum 3), may be aggregated, and the cleaning blade and the intermediate transfer belt 11 (the photosensitive drum 3) may be contacted as if they are bonded with each other. The inverse warpage will occur with high probability if the positive rotation is performed in such a state. In such special cases, the reverse rotation may be performed to prevent the inverse warpage, even if the reverse rotation should be prohibited in normal cases.

(6) In the above-described embodiments, the motor drive control process is performed when a printing operation is started. However, not limited to this, the motor drive control process may be performed before the photosensitive drum 3 or the intermediate transfer belt 11 is started rotating in the positive direction from the halt state, as necessity arises. For example, the motor drive control process may be performed when the device is powered on. This is because the photosensitive drum 3 and the like may need to be driven for warming up immediately after the power on, and if the motor drive control process is performed in such a case, the effect of preventing the inverse warpage and the like is obtained.

The motor drive control process may be performed when the device recovers from a trouble for a printing operation that occurred due to a paper jam or some defect. This is because the photosensitive drum 3 and the like may need to be driven when the device recovers from a trouble, as is the case with the power on.

Furthermore, when the device is provided with a power-saving function in which the power supply to the heater and the like is halted or reduced to save power, the motor drive control process may be performed when the device is released from the power-saving mode. This is because the photosensitive drum 3 and the like may need to be driven when the power supply to the heater and the like is resumed as the device is released from the power-saving mode.

(7) In the above-described embodiments, the image forming device of the present invention is applied to a tandem color digital printer. However, not limited to this, the present invention may be applied to any image forming device such as a copy machine, a facsimile machine, or an MFP (Multi Function Peripheral) regardless of a color or monochrome image forming device in so far as it can clean image carriers such as the photosensitive drum and the intermediate transfer belt by contacting the cleaning member therewith.

The present invention may also be applied to such an image forming device that includes an image processing unit for transferring an image, which is formed on a photosensitive drum, onto a transfer material such as a sheet, which is transported by a transfer material transport member such as a transport belt, and includes functions of forming a standard pattern such as a toner patch on the transfer material transport member, detecting density or the like of the formed standard pattern, and performing a known tone correction or resistance correction in accordance with the detection results.

This is because in such a device, in general, the transfer material transport member is cleaned as an image carrier by a cleaning member.

The cleaning member is not limited to the shape of a blade, but may be in any shape in so far as it is elastic and may have an inverse warpage or defect when it contacts with the image carrier to cause a defective cleaning. Also, the cleaning member is not limited to the urethane rubber in material.

The above-described embodiments and modifications are not limited to the single control that is described in each of them. That is to say, the above-described embodiments and modifications may be combined freely for implementation.

Although the present invention has been fully described by way of examples with reference to the accompanying drawings, it is to be noted that various changes and modifications will be apparent to those skilled in the art. Therefore, unless such changes and modifications depart from the scope of the present invention, they should be construed as being included therein.

What is claimed is:

1. An image forming device comprising:

an image carrier;

a cleaning member, made of an elastic material, operable to clean a surface of the image carrier by contacting with the surface;

a drive unit operable to rotate the image carrier in a reverse direction while the cleaning member is contacting with the surface of the image carrier, before the image carrier is rotated in a forward direction for an image formation; and a control unit operable to control the rotation of the image carrier in the reverse direction, in accordance with information indicating a size of a frictional force generated between the cleaning member and the image carrier being rotated, wherein the information indicates an image formation mode in which a preceding image formation job was executed, as an image formation history, and the control unit prohibits the image carrier from rotating in the reverse direction when the indicated image formation mode is a first mode in which one image formation job performs one image formation, and causes the image carrier to rotate in the reverse direction when the indicated image formation mode is a second mode in which one image formation job performs a plurality of image formations continuously.

2. The image forming device of claim 1 further comprising an image processing unit operable to form a latent image by exposing a photosensitive drum and develop the formed latent image, wherein the image carrier is the photosensitive drum.

3. The image forming device of claim 1 further comprising an image processing unit operable to transfer a formed image onto an intermediate transfer member as an initial transfer, and transfer the image from the intermediate transfer member onto a sheet as a secondary transfer, wherein the image carrier is the intermediate transfer member.

4. The image forming device of claim 1 further comprising an image processing unit operable to transfer a formed image onto a transfer material that is transported by a transfer material transport member, wherein the image carrier is the transfer material transport member.

5. An image forming method for an image forming device that includes a cleaning member, made of an elastic material, operable to clean a surface of an image carrier by contacting with the surface, the image forming method comprising:

a drive step for rotating the image carrier in a reverse direction while the cleaning member is contacting with the surface of the image carrier, before the image carrier is rotated in a forward direction for an image formation; and a control step for controlling the rotation of the image carrier in the reverse direction, in accordance with information that indicates a size of a frictional force generated between the cleaning member and the image carrier being rotated, wherein the information indicates an image formation mode in which a preceding image formation job was executed, as an image formation history, and the control step comprises prohibiting the image carrier from rotating in the reverse direction when the indicated image formation mode is a first mode in which one image formation job performs one image formation, and causing the image carrier to rotate in the reverse direction when the indicated image formation mode is a second mode in which one image formation job performs a plurality of image formations continuously.

6. An image forming device comprising:

an image carrier;

a cleaning member, made of an elastic material, operable to clean a surface of the image carrier by contacting with the surface;

a drive unit operable to rotate the image carrier in either a reverse direction or a forward direction;

a detection unit operable to detect a state of the image forming device;

a control unit operable to, upon receiving an image formation start signal, select a first operation mode or a second operation mode in accordance with the detected device state, wherein in the first operation mode, the image carrier is rotated in the reverse direction and then rotated in the forward direction, and in the second operation mode, the image carrier is rotated in the forward direction without being rotated in the reverse direction, wherein the information indicates an image formation mode in which a preceding image formation job was executed, as an image formation history, and the control unit is operable to prohibit the image carrier from rotating in the reverse direction when the indicated image formation mode is a first mode in which one image formation job performs one image formation, and cause the image carrier to rotate in the reverse direction when the indicated image formation mode is a second mode in which one image formation job performs a plurality of image formations continuously.

* * * * *